US009358544B2

(12) United States Patent
Dricken et al.

(10) Patent No.: US 9,358,544 B2
(45) Date of Patent: Jun. 7, 2016

(54) APPARATUS AND METHOD FOR A CRUSHER WITH AN INVERTED CYLINDER

(71) Applicants: Chuck Dricken, Kewaskum, WI (US); Alan Eisner, Mequon, WI (US); Dean Wolfe, West Bend, WI (US); Albert Van Mullem, Sussex, WI (US); Sean Neitzel, Kronenwetter, WI (US); Matthew B Haven, Cedarburg, WI (US)

(72) Inventors: Chuck Dricken, Kewaskum, WI (US); Alan Eisner, Mequon, WI (US); Dean Wolfe, West Bend, WI (US); Albert Van Mullem, Sussex, WI (US); Sean Neitzel, Kronenwetter, WI (US); Matthew B Haven, Cedarburg, WI (US)

(73) Assignee: Telsmith, Inc., Mequon, WI (US)

( * ) Notice: Subject to any disclaimer, the term of this patent is extended or adjusted under 35 U.S.C. 154(b) by 394 days.

(21) Appl. No.: 13/919,659

(22) Filed: Jun. 17, 2013

(65) Prior Publication Data

US 2013/0334348 A1 Dec. 19, 2013

Related U.S. Application Data

(60) Provisional application No. 61/690,048, filed on Jun. 18, 2012.

(51) Int. Cl.
*B02C 2/04* (2006.01)

(52) U.S. Cl.
CPC ..... *B02C 2/047* (2013.01); *B02C 2/045* (2013.01); *Y10T 29/49815* (2015.01); *Y10T 29/49826* (2015.01)

(58) Field of Classification Search
CPC ..... B02C 2/047; B02C 2/04
USPC ..... 241/207, 290, 286, 32
See application file for complete search history.

(56) References Cited

U.S. PATENT DOCUMENTS

| | | | | |
|---|---|---|---|---|
| 4,717,084 | A | 1/1988 | Vendelin et al. | |
| 2009/0152385 | A1 * | 6/2009 | Vendelin | B02C 2/04 241/207 |

FOREIGN PATENT DOCUMENTS

| | | |
|---|---|---|
| WO | WO/2011091403 | 7/2011 |

* cited by examiner

*Primary Examiner* — Mark Rosenbaum
(74) *Attorney, Agent, or Firm* — Chambliss, Bahner & Stophel, P.C.

(57) ABSTRACT

A crusher adapted to crush feed materials comprising a main frame, a secondary frame disposed adjacent to the main frame, a crushing chamber adapted to receive feed materials, and a tramp iron relief system comprising a cylinder. The tramp iron relief system is adapted to allow a portion of the secondary frame to move away from the main frame. The cylinder is disposed substantially adjacent to the secondary frame. A method for installing a cylinder on a crusher and a method for removing a cylinder from a crusher wherein a lifting device remains attached to the cylinder continuously during each operation.

13 Claims, 7 Drawing Sheets

APPARATUS AND METHOD FOR A CRUSHER WITH AN INVERTED CYLINDER

CROSS-REFERENCES TO RELATED APPLICATIONS/PATENTS

This application relates back to and claims priority from U.S. Provisional Application for patent Ser. No. 61/690,048 entitled "Apparatus and Method for Inverted Relief Cylinders" and filed on Jun. 18, 2012.

FIELD OF THE INVENTION

The present invention relates generally to crushers with cylinders, and particularly to rock crushers with inverted relief cylinders adapted for use in tramp iron relief systems.

BACKGROUND AND DESCRIPTION OF THE PRIOR ART

It is known to use relief cylinders in the tramp iron relief system on rock crushers. Conventional relief cylinders in the tramp iron relief systems of rock crushers, however, suffer from one or more disadvantages. For example, conventional relief cylinders are disposed below the upper frame flange, the lower frame flange and/or the service platform. As a result, it is difficult and time-consuming to install and remove conventional relief cylinders. In addition, the installation and removal of conventional relief cylinders is unnecessarily unsafe and expensive. Further, the installation and removal of conventional relief cylinders undesirably requires a lifting device to pass through the relief cylinder holes in the upper and lower frame flanges. Still further, conventional relief cylinders cannot be moved to an unlimited number of locations without detaching the lifting device from the relief cylinder, pulling the lifting device out of the relief cylinder holes in the upper and lower frame flanges, and re-attaching the lifting device to the relief cylinder.

It would be desirable, therefore, if an apparatus and method for a crusher having a relief cylinder could be provided that would be easier and less time-consuming to install and remove the relief cylinder. It would also be desirable if such an apparatus and method could be provided that would be safer and less expensive to install and remove a relief cylinder. It would be further desirable if such an apparatus and method could be provided that would not require the lifting device to pass through the relief cylinder holes in the upper and lower frame flanges when installing and removing a relief cylinder. It would be still further desirable if such an apparatus and method could be provided that would allow a removed relief cylinder to be moved to an unlimited number of locations without first detaching the lifting device from the relief cylinder.

Advantages of the Preferred Embodiments of the Invention

It is an advantage of the preferred embodiments of the invention described and claimed herein to provide a crusher having a relief cylinder that is easier and less time-consuming to install on and remove from the crusher. It is also an advantage of the preferred embodiments of the invention to provide a relief cylinder that is safer and less expensive to install on and remove from the crusher. It is a further advantage of the preferred embodiments of the invention to provide a relief cylinder that does not require the lifting device to pass through the relief cylinder holes in the upper and lower frame flanges when installing and removing a relief cylinder. It is a still further advantage of the preferred embodiments of the invention to provide a relief cylinder that may be moved to an unlimited number of locations without first detaching the lifting device from the relief cylinder.

Additional advantages of the preferred embodiments of the invention will become apparent from an examination of the drawings and the ensuing description.

EXPLANATION OF THE TECHNICAL TERMS

As used herein, the term "crusher" shall mean any device, mechanism, assembly or combination thereof that is adapted to crush feed material. The term "crusher" shall include without limitation rock crushers, gyratory crushers, cone crushers, jaw crushers, compound crushers, impact crushers and the like.

As used herein, the term "cylinder" shall mean any device, mechanism, assembly or combination thereof that is adapted to move or be moved between a retracted position and an extended position so as to impart a mechanical force. The term "cylinder" shall include without limitation liner actuators, rotary actuators, hydraulic cylinders, hydraulic rotary actuators, pneumatic cylinders, springs and the like.

As used herein, the term "feed materials" shall mean any coarse material adapted to be fed into a crusher. The term "feed materials" shall include without limitation sand, gravel, stone, slag, recycled concrete, geosynthetic material, glass and the like.

As used herein, the term "lifting device" shall mean any device, mechanism, assembly or combination thereof that is adapted to lift and convey a cylinder. The term "lifting device" shall include without limitation cranes, hoists, jacks, winches, pulleys and the like.

As used herein, the term "relief valve" shall mean any device, mechanism, assembly or combination thereof adapted to provide pressure relief. The term "relief valve" shall include without limitation relief valves, accumulators, springs and the like.

As used herein, the term "tramp iron relief system" shall mean any device, mechanism, assembly or combination thereof that is adapted to hold a secondary frame in a predetermined position relative to a main frame at a pre-determined force such that if the pre-determined force is exceeded the secondary frame will move relative to the main frame.

As used herein, the term "uncrushable object" shall mean any material that is not adapted to be crushed by a crusher under normal operating conditions. The term "uncrushable object" shall include without limitation tramp iron, tramp metal, clay, mud, plastic, wood, tightly-spaced agglomerations such as sand and rock and the like.

SUMMARY OF THE INVENTION

The apparatus of the invention comprises a crusher adapted to crush feed materials. The preferred crusher comprises a main frame, a secondary frame disposed adjacent to the main frame, a crushing chamber adapted to receive feed materials, and a tramp iron relief system comprising a cylinder. The preferred tramp iron relief system is adapted to allow a portion of the secondary frame to move away from the main frame. The preferred cylinder is disposed substantially adjacent to the secondary frame.

The method of the invention comprises a method for installing a cylinder on a crusher. The preferred method comprises providing a crusher having a main frame, a secondary frame disposed adjacent to the main frame, a crushing chamber adapted to receive feed materials, and a tramp iron relief system comprising a cylinder. The preferred tramp iron relief system is adapted to allow a portion of the secondary frame to move away from the main frame. The preferred cylinder is disposed substantially adjacent to the secondary frame. The preferred method further comprises attaching a lifting device to an install cylinder located away from the crusher, lifting the install cylinder with the lifting device attached to the install cylinder, conveying the install cylinder to a desired location on the crusher with the lifting device attached to the install cylinder, and detaching the lifting device from the install cylinder when the install cylinder is in the desired location. In the preferred method, the lifting device remains attached to the install cylinder continuously from the time the lifting device is attached to the install cylinder located away from the crusher until the lifting device is detached from the install cylinder at the desired location on the crusher.

The method of the invention also comprises a method for removing a cylinder from a crusher. The preferred method comprises providing a crusher having a main frame, a secondary frame disposed adjacent to the main frame, a crushing chamber adapted to receive feed materials, and a tramp iron relief system comprising a cylinder. The preferred tramp iron relief system is adapted to allow a portion of the secondary frame to move away from the main frame. The preferred cylinder is disposed substantially adjacent to the secondary frame. The preferred method further comprises attaching a lifting device to a remove cylinder located on the crusher, lifting the remove cylinder with the lifting device attached to the remove cylinder, conveying the remove cylinder to a desired location away from the crusher with the lifting device attached to the remove cylinder, and detaching the lifting device from the remove cylinder when the remove cylinder is in the desired location. In the preferred method, the lifting device remains attached to the remove cylinder continuously from the time the lifting device is attached to the remove cylinder located on the crusher until the lifting device is detached from the remove cylinder at the desired location away from the crusher.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
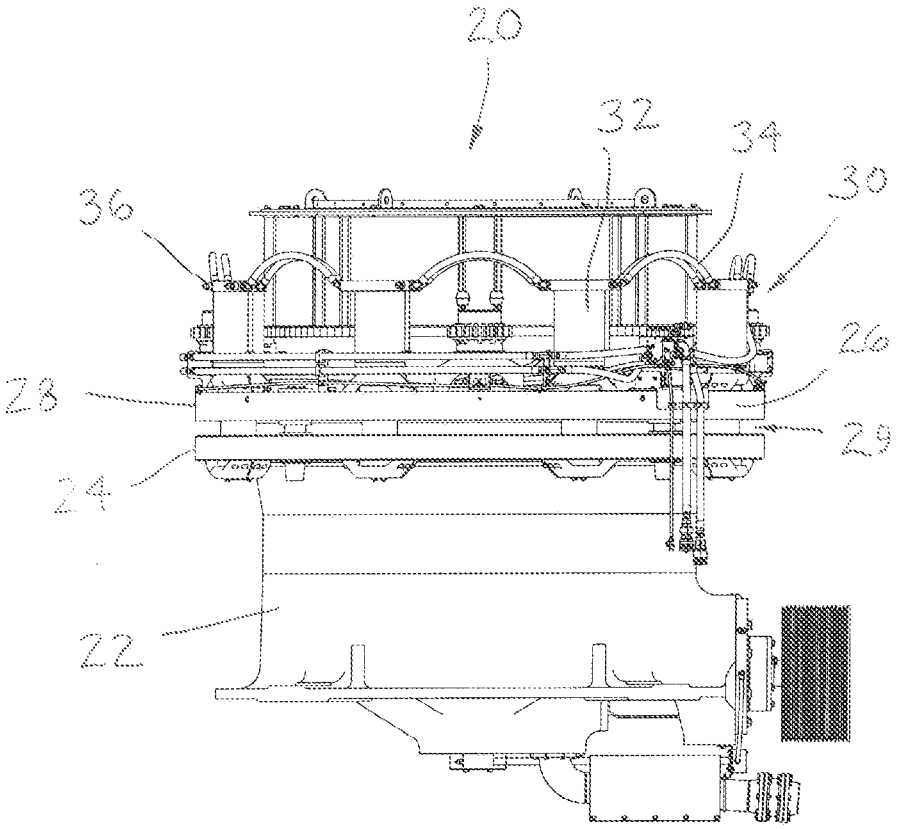
FIG. 1 is a front view of an exemplary rock crusher equipped with the preferred relief cylinders in accordance with the present invention.

Referring now to the drawings, the preferred embodiment of the apparatus and method for a crusher having an inverted relief cylinder in accordance with the present invention is illustrated by FIGS. 1 through 7. As shown in FIGS. 1-7, the preferred apparatus and method for a crusher having an inverted relief cylinder is adapted to provide a relief cylinder that is easier and less time-consuming to install on and remove from the crusher. The preferred embodiments of the invention also provide a relief cylinder that is safer and less expensive to install on and remove from the crusher. The preferred embodiments of the invention further provide a relief cylinder that does not require the lifting device to pass through the relief cylinder holes in the upper and lower frame flanges when installing and removing the relief cylinder. The preferred embodiments of the invention still further provide a relief cylinder that may be moved to an unlimited number of locations without first detaching the lifting device from the relief cylinder.

Referring now to FIG. 1, a front view of an exemplary rock crusher equipped with a plurality of the preferred relief cylinders in accordance with the present invention is illustrated. As shown in FIG. 1, the exemplary rock crusher is designated generally by reference numeral 20. Preferred rock crusher 20 is adapted to crush feed materials and comprises a main frame such as lower frame 22 having lower frame flange 24. Preferred rock crusher 20 also comprises a secondary frame such as upper frame 26 having upper frame flange 28. In preferred rock crusher 20, upper frame 26 is disposed such that lower frame flange 24 and upper frame flange 28 define gap 29 therebetween. Preferred rock crusher 20 further comprises tramp iron relief system 30 having a plurality of cylinders such as relief cylinders 32, hoses 34 and relief valves 36. Preferably, tramp iron relief system 30 is adapted to allow a portion of upper frame 26 to move away from lower frame 22 when an uncrushable object enters the crushing chamber (see FIGS. 2 and 3) of crusher 20. In preferred rock crusher 20, tramp iron system 30 is adapted to increase the size of a portion of gap 29 between lower frame flange 24 and upper frame flange 28 when an uncrushable object enters the crushing chamber of the crusher. It is also contemplated within the scope of the invention, however, that preferred tramp iron relief system 30 is adapted to allow the entire upper frame 26 to be moved away from lower frame 22 in the event of a crusher shutdown. In addition, preferred cylinders 32 are removably attached to crusher 20 such that they are disposed substantially adjacent to upper frame 26. Further, preferred relief cylinders 32 are disposed in an inverted arrangement such that the rod end is closer to lower frame 22 than the base end (see FIGS. 3-5).

While FIG. 1 illustrates the preferred configuration and arrangement of rock crusher 20, it is contemplated within the scope of the invention that the preferred crusher may be of any suitable configuration and arrangement. It is also contemplated within the scope of the invention that the preferred tramp iron relief system may include only one cylinder or any number of cylinders. It is also contemplated within the scope of the invention that accumulators, springs and other relief devices, mechanisms, assemblies and combinations thereof may be used in place of or in combination with relief valves.

Figure 2:
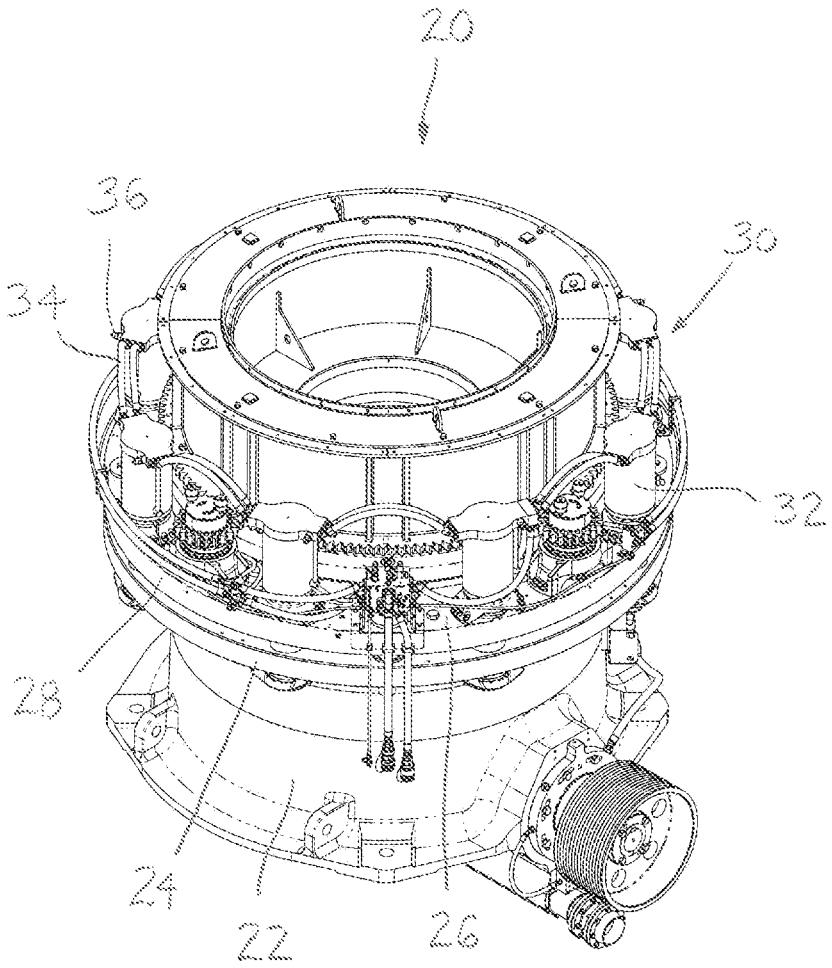
FIG. 2 is a perspective view of the exemplary rock crusher illustrated in FIG. 1.

Referring now to FIG. 2, a perspective view of exemplary rock crusher 20 is illustrated. As shown in FIG. 2, preferred rock crusher 20 comprises lower frame 22 having lower frame flange 24. Preferred rock crusher 20 also comprises upper frame 26 having upper frame flange 28. Preferred rock crusher 20 further comprises tramp iron relief system 30 having a plurality of cylinders such as relief cylinders 32, hoses 34 and relief valves 36.

Figure 3:
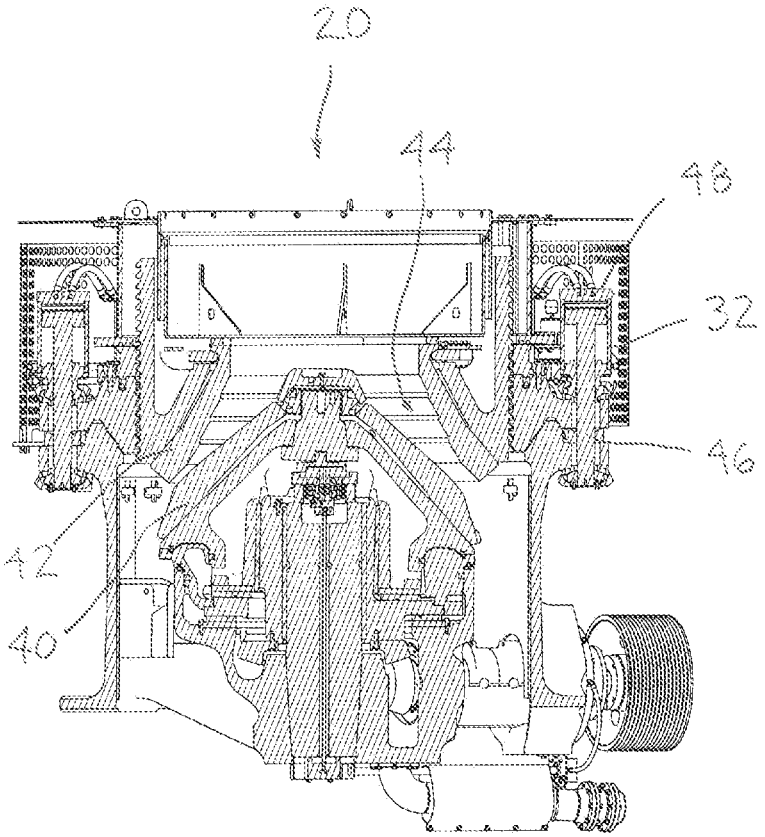
FIG. 3 is a partial sectional front view of the exemplary rock crusher illustrated in FIGS. 1-2 with the relief cylinders in a retracted position.

Referring now to FIG. 3, a partial sectional front view of exemplary rock crusher 20 is illustrated. As shown in FIG. 3, preferred cone 40 and preferred bowl 42 define crushing chamber 44 which is adapted to receive feed materials. As also shown in FIG. 3, preferred relief cylinder 32 is in a retracted position. More particularly, when preferred relief cylinder 32 is in a retracted position, rod 46 is disposed near base end 48. In addition, when preferred relief cylinder 32 is in a retracted position, the distance between preferred cone 40 and preferred bowl 42 is relatively small and exemplary rock crusher 20 is adapted to crush feed materials received in preferred crushing chamber 44 to the desired size. In the retracted position, however, exemplary rock crusher 20 may not be adapted to allow large uncrushable objects such as tramp iron to pass through preferred crushing chamber 44.

Figure 4:
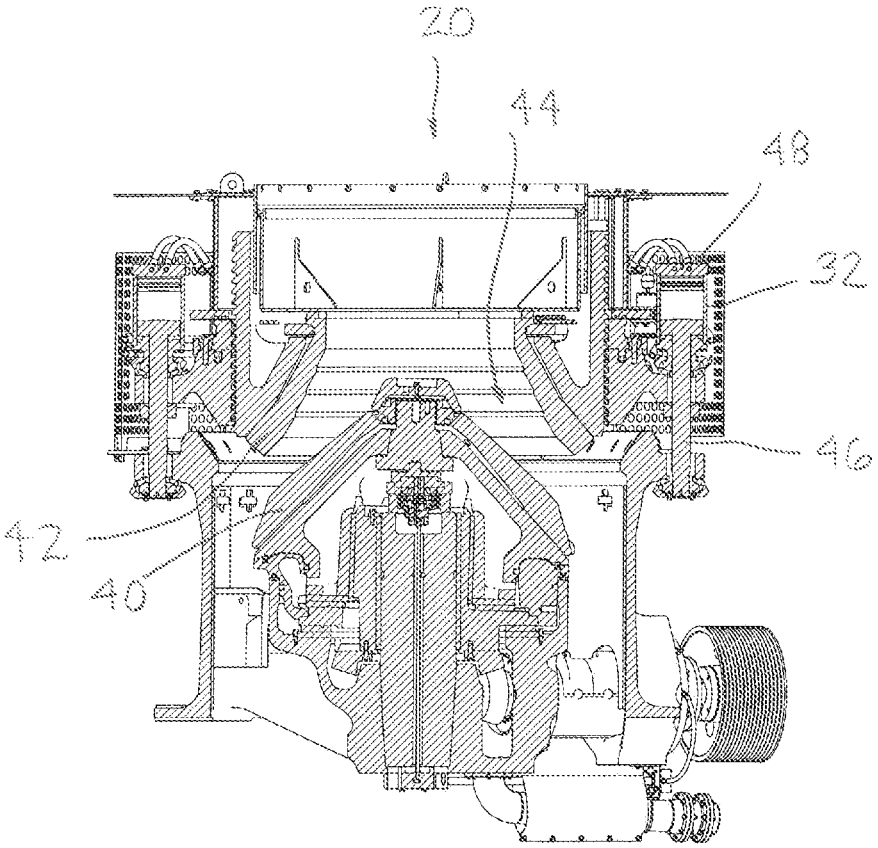
FIG. 4 is a partial sectional front view of the exemplary rock crusher illustrated in FIGS. 1-3 with the relief cylinders in an extended position.

Referring now to FIG. 4, a partial sectional front view of exemplary rock crusher 20 is illustrated. As shown in FIG. 4, preferred relief cylinder 32 is in an extended position. When preferred relief cylinder 32 is in an extended position, rod 46 is disposed away from base end 48. In addition, when preferred relief cylinder 32 is in an extended position, the distance between preferred cone 40 and preferred bowl 42 is relatively large and exemplary rock crusher 20 is adapted to allow large uncrushable objects such as tramp iron or uncrushed feed to pass through and out of preferred crushing chamber 44.

Figure 5:
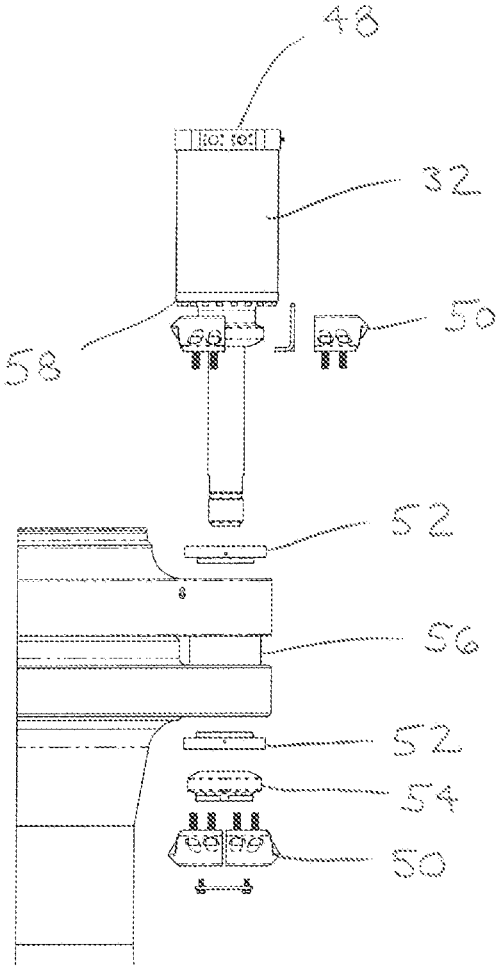
FIG. 5 is an exploded front view of the preferred relief cylinder assembly illustrated in FIGS. 1-4.

Referring now to FIG. 5, an exploded front view of the preferred relief cylinder assembly is illustrated. As shown in FIG. 5, the preferred relief cylinder assembly comprises relief cylinder 32, base end 48, cylinder retainers 50, spherical washers 52, spherical nut 54, cylinder rod seal 56 and rod end 58. While FIG. 5 illustrates the preferred configuration and arrangement of the preferred relief cylinder assembly, it is contemplated within the scope of the invention that the preferred relief cylinder assembly may be of any suitable configuration and arrangement. It is also contemplated within the scope of the invention that the preferred relief cylinder 32 may be removably attached to the rock crusher by any suitable means, including without limitation, threaded fasteners such as bolts, clevis attachments, tubes, swivel mounts, pins, rods, couplers and the like. More particularly, it is contemplated within the scope of the invention that the spherical nut may be some other spherical surface that is retained on the cylinder rod and that the spherical surface may be eliminated.

Figure 6:
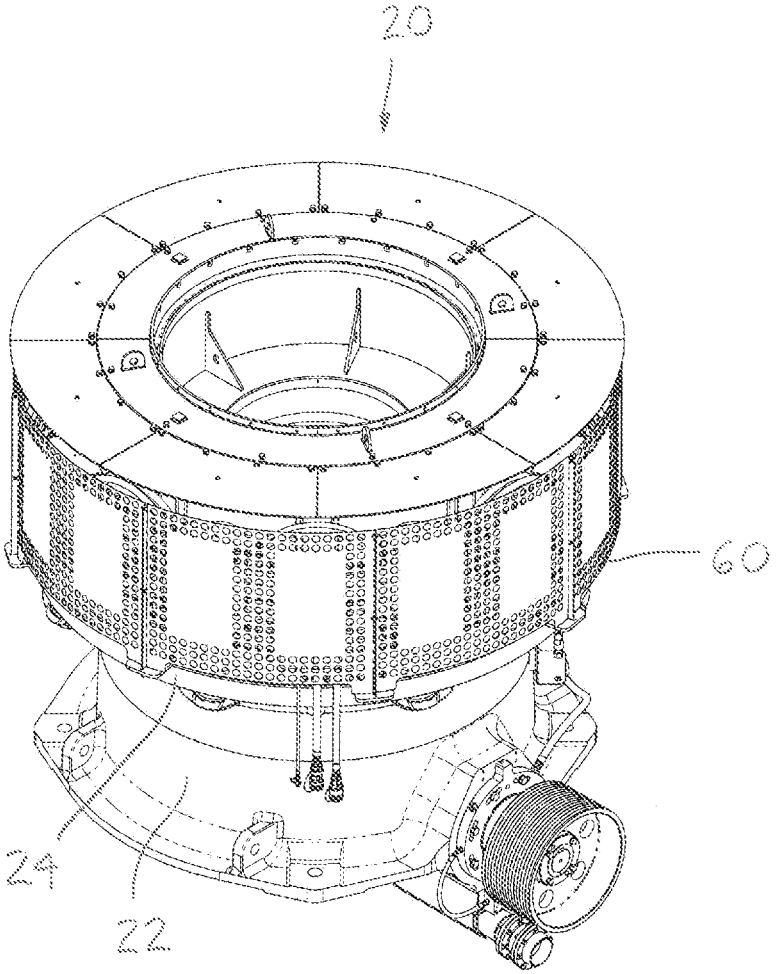
FIG. 6 is a perspective view of the exemplary rock crusher illustrated in FIGS. 1-5 equipped with the preferred relief cylinder shroud.

Referring now to FIG. 6, a perspective view of exemplary rock crusher 20 equipped with the preferred relief cylinder shroud is illustrated. As shown in FIG. 6, exemplary rock crusher 20 comprises lower frame 22 having lower frame flange 24. Preferred rock crusher 20 is also equipped with a shroud such as preferred relief cylinder shroud 60. Preferred relief cylinder shroud 60 is adapted to prevent aggregate materials and other objects and equipment from damaging the tramp iron relief system in general and the relief cylinders in particular. Preferred relief cylinder shroud 60 is also adapted to improve human safety, e.g., by making pinch points inaccessible. The preferred relief cylinder shroud 60 is removably attached to rock crusher 20. While FIG. 6 illustrates the preferred configuration and arrangement of shroud 60, it is contemplated within the scope of the invention that the preferred shroud may be of any suitable configuration and arrangement.

Figure 7:
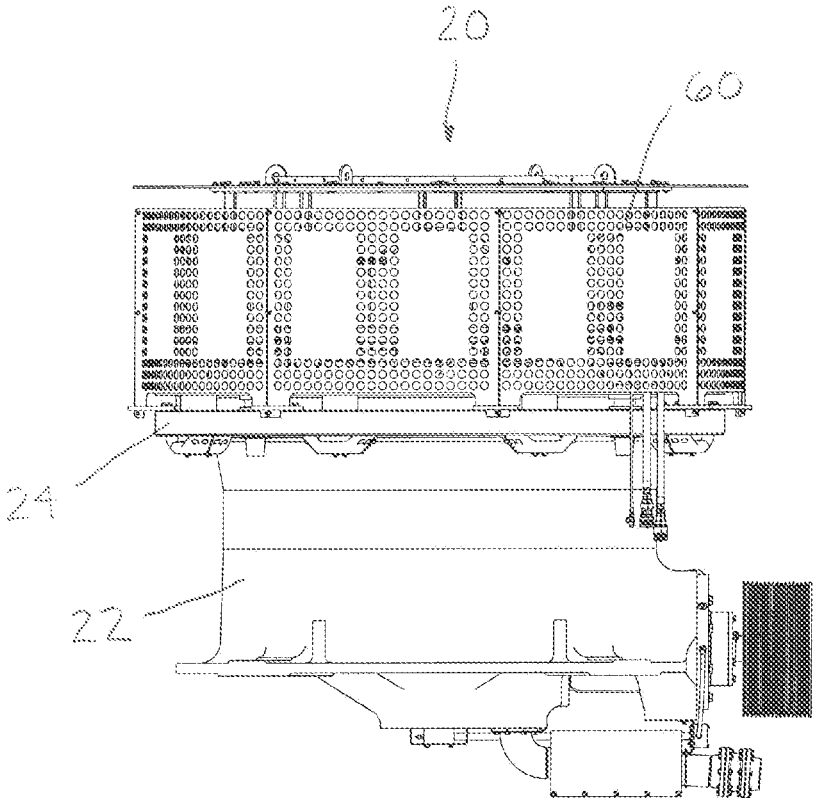
FIG. 7 is a front view of the exemplary rock crusher illustrated in FIGS. 1-6 equipped with the preferred relief cylinder shroud.

Referring now to FIG. 7, a front view of exemplary rock crusher 20 equipped with preferred relief cylinder shroud 60 is illustrated. As shown in FIG. 7, preferred rock crusher 20 comprises lower frame 22 having lower frame flange 24 and relief cylinder shroud 60.

The method of the invention comprises a method for installing a cylinder on a crusher. The preferred method comprises providing a crusher having a main frame, a secondary frame disposed adjacent to the main frame, a crushing chamber adapted to receive feed materials, and a tramp iron relief system comprising a cylinder. The preferred tramp iron relief system is adapted to allow a portion of the secondary frame to move away from the main frame. The preferred cylinder is disposed substantially adjacent to the secondary frame. The preferred method further comprises attaching a lifting device to an install cylinder located away from the crusher, lifting the install cylinder with the lifting device attached to the install cylinder, conveying the install cylinder to a desired location on the crusher with the lifting device attached to the install cylinder, and detaching the lifting device from the install cylinder when the install cylinder is in the desired location. In the preferred method, the lifting device remains attached to the install cylinder continuously from the time the lifting device is attached to the install cylinder located away from the crusher until the lifting device is detached from the install cylinder at the desired location on the crusher.

Also in the preferred methods of the invention, the method comprises the steps of placing a cylinder rod seal on the main frame, placing a spherical washer on the secondary frame, installing a cylinder retainer on the secondary frame, placing a spherical washer on the main frame, placing a spherical nut on the main frame, and installing a cylinder retainer on the main frame. More particularly, the installation of the preferred cylinder is accomplished by placing the cylinder rod dust seal on the lower frame prior to setting the upper frame on the lower frame. Next, a spherical washer is placed on top of the upper frame flange in each cylinder location. Then a cylinder is lifted by its base end and the rod is lowered through a hole in the upper frame flange and a hole in the lower frame flange and set on the spherical washer. Cylinder retainers are then installed on the top of the upper frame flange and a spherical washer and a spherical nut are installed underneath the lower frame flange. Finally, cylinder retainers are installed underneath the lower frame flange. The removal of the preferred cylinder is accomplished by attaching a lifting device to the base end of the cylinder, removing the hoses, cylinder retainers, and spherical nut from underneath the lower frame flange, and lifting the cylinder from the crusher.

The method of the invention also comprises a method for removing a cylinder from a crusher. The preferred method comprises providing a crusher having a main frame, a secondary frame disposed adjacent to the main frame, a crushing chamber adapted to receive feed materials, and a tramp iron relief system comprising a cylinder. The preferred tramp iron relief system is adapted to allow a portion of the secondary frame to move away from the main frame. The preferred cylinder is disposed substantially adjacent to the secondary frame. The preferred method further comprises attaching a lifting device to a remove cylinder located on the crusher, lifting the remove cylinder with the lifting device attached to the remove cylinder, conveying the remove cylinder to a desired location away from the crusher with the lifting device attached to the remove cylinder, and detaching the lifting device from the remove cylinder when the remove cylinder is in the desired location. In the preferred method, the lifting device remains attached to the remove cylinder continuously from the time the lifting device is attached to the remove cylinder located on the crusher until the lifting device is detached from the remove cylinder at the desired location away from the crusher.

In operation, the rod end of the preferred cylinder is pressurized causing the rod to retract such that it is disposed near the base end. In this retracted position, the upper frame is held in close proximity to the lower frame and crushing operations may proceed. During crushing operations, if an uncrushable object enters the crushing chamber, the portion of the upper frame in the area of the uncrushable object moves away from the lower frame causing the cylinder rod to extend (i.e., move away from the base end of the cylinder) and the pressure in the rod end of the cylinder to increase. When the pressure in the rod end of the cylinder exceeds a pre-determined level, the relief valve on the cylinder causes fluid in the rod end of the cylinder to be removed from the cylinder and the cylinder rod extends further. As the cylinder rod extends further, the portion of the upper frame adjacent to the cylinder is moved farther away from the lower frame, and the distance between the bowl and the cone increases. As the crusher head gyrates, the distance between the bowl and the cone increases for a short time with each revolution, thereby allowing the uncrushable object to gradually move through the crushing chamber until it reaches the end of the chamber and passes out of the chamber. After the uncrushable object passes through and out of the crushing chamber, fluid is conveyed back into the rod end of the cylinder causing the cylinder rod to retract (i.e., move toward the base end of the cylinder) and the upper frame to move closer to the lower frame. The fluid will continue to be conveyed back to the rod end of the cylinder until the pressure in the cylinder reaches a pre-determined level.

Additionally, in the event of a crusher shutdown, the crushing chamber may be cleared of all feed materials by increasing the pressure in the base ends and decreasing the pressure in the rod ends of all the preferred cylinders such that the cylinder rods extend and the entire upper frame is moved away from the lower frame. After all feed materials are allowed to pass through and out of the crushing chamber, the rod ends of all the preferred cylinders may be pressurized so as to retract the cylinder rod and move the entire upper frame toward the lower frame and crushing operations may be resumed. It is also contemplated within the scope of the invention that in the event of a crusher shutdown, the crushing chamber may be cleared of all feed materials by decreasing the pressure in the rod ends of all the preferred cylinders, and after the crushing chamber is cleared of all feed materials, increasing the pressure in the rod ends of the cylinders. It is further contemplated within the scope of the invention that the tramp iron system may comprise cylinders in which the pressure in the base end of the cylinders is varied and cylinders in which the pressure in the rod end of the cylinders is varied.

While the foregoing describes the preferred operation of the crusher in accordance with the present invention, it is also contemplated that the tramp iron relief system may comprise cylinders with accumulators that adapted to extend and retract the cylinder. More particularly, an accumulator bladder having a pressure level that is slightly lower than the pressure level in the rest of tramp iron relief system is provided for each cylinder. When an uncrushable object enters the crusher chamber, the pressure level in the cylinders increases and the accumulator bladders compress. When the accumulator bladders compress, fluid is allowed to be conveyed out of the rod end of the cylinder and the cylinder rods extend. When the cylinder rods extend, the upper frame is moved away from the lower frame and the distance between the bowl and the cone increases so as to allow the uncrushable object to pass through and out of the crushing chamber. When the uncrushable object passes through and out of the crushing chamber, the pressure in the cylinders decrease and the accumulator bladder expands so as to convey fluid into the rod end of the cylinder and cause the cylinder rod to retract. It is also contemplated within the scope of the invention that the tramp iron relief system may comprise one or more cylinders having relief valves and one or more cylinders having accumulators. It is further contemplated within the scope of the invention that the tramp iron relief system may comprise one or more cylinders and one or more springs. It is also contemplated within the scope of the invention that one or more cylinders may not have a relief valve, an accumulator, a spring or any other type of relief device.

In operation, several advantages of the preferred embodiments of the method and apparatus for a crusher having inverted relief cylinders are achieved. For example, the preferred embodiments of the invention provide a relief cylinder that is easier and less time-consuming to install on and remove from a crusher. The preferred embodiments of the invention also provide a relief cylinder that is safer and less expensive to install on and remove from a crusher. The preferred embodiments of the invention further provide a relief cylinder that does not require the lifting device to pass through the relief cylinder holes in the upper and lower frame flanges when installing and removing a relief cylinder. The preferred embodiments of the invention still further provide a relief cylinder that allows a removed relief cylinder to be moved to an unlimited number of locations without first detaching the lifting device from the relief cylinder.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A crusher adapted to crush feed materials, said crusher comprising:

(a) a main frame;

(b) a secondary frame, said secondary frame being disposed adjacent to the main frame;

(c) a crushing chamber, said crushing chamber being adapted to receive feed materials;

(d) a tramp iron relief system, said tramp iron relief system comprising a cylinder; wherein the cylinder is adapted to move between a retracted position and an extended position, and wherein the secondary frame is moved away from the main frame when the cylinder is in the extended position, and wherein the cylinder is disposed substantially adjacent to the secondary frame of the crusher.

2. The crusher of claim 1 wherein the tramp iron relief system further comprises a cylinder retainer.

3. The crusher of claim 1 wherein the tramp iron relief system further comprises a spherical washer.

4. The crusher of claim 1 wherein the tramp iron relief system further comprises a spherical nut.

5. The crusher of claim 1 wherein the tramp iron relief system further comprises a cylinder rod seal.

6. The crusher of claim 1 further comprising a shroud.

7. The crusher of claim 1 further comprising a relief valve.

8. A gyratory cone crusher adapted to crush feed materials, said crusher comprising:

(a) a lower frame, said lower frame having a lower frame flange;

(b) an upper frame, said upper frame having an upper frame flange and being disposed such that the lower frame flange and the upper frame flange define a gap therebetween;

(c) a crushing chamber, said crushing chamber being adapted to receive feed materials;

(d) a tramp iron relief system, said tramp iron relief system comprising a plurality of relief cylinders;

wherein the plurality of relief cylinders are adapted to move between a retracted position and an extended position, and wherein the upper frame is moved away from the lower frame when one or more of the plurality of relief cylinders is in the extended position, and wherein the plurality of relief cylinders are disposed substantially above the lower frame flange of the crusher.

9. The crusher of claim 8 wherein the tramp iron relief system further comprises a cylinder retainer.

10. The crusher of claim 8 wherein the tramp iron relief system further comprises a spherical washer.

11. The crusher of claim 8 wherein the tramp iron relief system further comprises a spherical nut.

12. The crusher of claim 7 wherein the tramp iron relief system further comprises a cylinder rod seal.

13. The crusher of claim 8 further comprising a shroud.

* * * * *